United States Patent [19]

Karpellus

[11] Patent Number: 4,984,937

[45] Date of Patent: Jan. 15, 1991

[54] ROCK BOLT

[75] Inventor: Walter Karpellus, Innsbruck, Austria

[73] Assignee: Ingenieure Mayreder, Kraus & Co. Baugesellschaft m.b.H., Vienna, Austria

[21] Appl. No.: 391,579

[22] PCT Filed: Nov. 15, 1988

[86] PCT No.: PCT/AT88/00097

§ 371 Date: Jul. 11, 1989

§ 102(e) Date: Jul. 11, 1989

[87] PCT Pub. No.: WO89/04911

PCT Pub. Date: Jun. 1, 1989

[30] Foreign Application Priority Data

Nov. 16, 1987 [AT] Austria ..... 3020/87

[51] Int. Cl.[5] ..... E21D 21/02

[52] U.S. Cl. ..... 405/260; 405/259; 411/8; 411/9

[58] Field of Search ..... 405/259, 260, 261; 411/1, 2, 3, 5, 9, 10

[56] References Cited

U.S. PATENT DOCUMENTS

| | | | |
|---|---|---|---|
| 3,967,455 | 7/1976 | Conway | 411/548 X |
| 4,187,040 | 2/1980 | Donan | 405/259 |
| 4,472,088 | 9/1984 | Martin | 405/259 |
| 4,519,735 | 5/1985 | Machtle | 405/259 X |
| 4,613,254 | 9/1986 | Liebig | 405/259 |
| 4,648,753 | 3/1987 | Stephan | 405/260 |
| 4,789,284 | 12/1988 | White | 405/259 X |
| 4,850,746 | 7/1989 | Finsterwalder et al. | 405/260 |

FOREIGN PATENT DOCUMENTS 1583803 2/1972 Fed. Rep. of Germany .

*Primary Examiner*—Randolph A. Reese
*Assistant Examiner*—John Ricci
*Attorney, Agent, or Firm*—Kurt Kelman

[57] ABSTRACT

A rock bolt comprises a bolt rod secured in a borehole, a retaining plate attached outside the borehole, a bolt head for the retaining plate, and a supporting connection between the bolt rod and the retaining plate. The supporting connection comprises a tubular member adapted to be inserted into the bore hole, the tubular member having an outer end and an inner end, the outer tubular member end bearing on the retaining plate, and a compressively loaded, deformable and upsettable sleeve member accommodated with a clearance in the tubular member and held between a rodside thrust face and a plateside thrust face constituted by a collar adjacent the inner tubular member end.

7 Claims, 4 Drawing Sheets

ROCK BOLT

This invention relates to a rock bolt comprising a bolt rod adapted to be secured in a borehole, a bolt head for a retaining plate adapted to be attached outside the borehole, and a compressively loaded deformable member, which surrounds the bolt rod, incorporated in the supporting connection between the retaining plate and the bolt rod.

In the provision of supports and lining in underground cavities and particularly in the construction of tunnels or galleries such rock bolts serve as safety elements, which are systematically set to extend approximately radially to the axis of the tunnel or gallery and take up a more or less large part of the rock pressure and introduce the forces they have taken up into the depths of the rock which correspond to the borehole so that the rock contributes to the support. In order to avoid a load on the bolt rods in excess of the ultimate load and because the radial rock pressure decreases with the deformation, rock bolts are used which are of the kind described first hereinbefore and which permit a controlled deformation of the rock within certain limits so that they permit a simplification of the supporting structure in the provision of supports and lining in underground cavities.

A rock bolt which is of the kind mentioned first hereinbefore is known from Austrian Patent Specification No. 378,823. A bolt head which is secured to the bolt rod protrudes outwardly through an opening of the retaining plate and a sleeve is inserted between the bolt head and the retaining plate and under a corresponding load will be expanded by the conical or spherical bolt head as it penetrates so that the anchoring structure will be yieldable in dependence on the elongation behavior of the supporting sleeve. German Patent Specification No. 1,583,803 discloses a rock bolt which has a bolt head that is supported on the retaining plate and constitutes a drawing die, which surrounds the bolt rod at a distance from its protruding end, which is smaller in diameter in the region in which the drawing die is attached so that the grooved bolt rod can be drawn out through the drawing die with a removal of material and/or deformation. The two known designs are expensive owing to the required selection and quality of the materials and in dependence on the length in which a deformation is desired they must protrude from the retaining plate to a considerable extent and can take up only smaller supporting forces and only a small influence can be exerted on the resistance of the shaped part to deformation, i.e., on the deforming process and also on the characteristic of the resistance which opposes the drawing-in of the bolt rod.

It is an object of the invention to eliminate the disadvantages which have been pointed out and to provide a rock bolt which can rationally be manufactured and can be set in a simple manner and in case of need can be designed to have no parts which protrude a large distance from the borehole and will provide a yieldable support which has an adjustable and/or selectable characteristic and with full utilization of the load-carrying capacity which is determined by the strength of the bolt rod will permit an influence to be exerted on the dependence between supporting forces and the deformation.

The object set forth is accomplished according to the invention by the deformable member constituting an upsettable sleeve member accommodated with a clearance in a tubular member adapted to be inserted into the borehole and held between a rodside thrust face and a plateside thrust face, the tubular member having an outer end bearing on the retaining plate and comprising a collar constituting the plateside thrust face adjacent an inner end thereof.

The upsettable member can be made without a high expenditure and by the selection of its wall thickness, shape and material and by the provision of a profile etc. may be provided to have an upsetting behavior which is well adapted to the load conditions which are to be expected. Any risk of a sudden yielding caused by material defects will be precluded. Above all, it is possible to select a resistance to deformation which will exhibit a controlled rise as the load increases so that the rock will be progressively supported as the deformation increases. Also, the upsettable sleeve member can be inserted into the borehole together with the tubular member so that the extent to which the entire bolt protrudes from the borehole can be minimized. The tubular member will protect the upsettable sleeve member from being soiled and the resistance to deformation of the sleeve member may be influenced by the clearance between the tubular member and the sleeve member if, for example, the upsettable sleeve member is profiled in wave shape or can be compressed into wave shape in its longitudinal direction.

Peripheral grooves in the sleeve or a wave-shaped longitudinal profile will permit the upsetting behavior to be exactly predetermined by the selection of the shape and number of the grooves or shafts and the corresponding depth. Where grooves are provided the total width of the groove will determine the extent of the deformation which is possible in conjunction with a lower resistance to deformation. If the depth of the grooves decreases in the direction of the bolt head toward the fixing end of the bolt rod, the resistance to deformation can be influenced in a controlled manner and it is possible, e.g., to ensure that the resistance to deformation will increase with the extent of the deformation. It will even be possible to design the entire sleeve as a compression spring or to arrange a compression spring, which is, e.g., sleevelike, and a deformable sleeve in series.

Where the end of the tubular member constitutes a portion of the bolt head, the upsettable sleeve member may be disposed between an outer backing ring of the bolt rod and an inner backing ring, which constitutes the collar and is provided on the tubular member, the latter engaging the retaining plate by means of an anchor nut. To permit a simple manufacture in that case, the tubular member has external screw threads for the anchor nut and a screw-threaded sleeve constituting the external screw threads is mounted on the tubular member.

Similarly, if the threaded bolt serves as a bolt head, the tubular member may be provided with a nut inserted into that end which has no backing ring, and the nut is screwed on an outwardly protruding screw-threaded bolt which axially succeeds the bolt rod. The lengths of the bolt rod, which may be as desired, and of the threaded bolt may be matched as desired.

The deformation of the rock will result in a deformation of the upsettable member. The outer end portion of the bolt rod, which is also subject to elongation, is drawn into the borehole. If the hollow bolt rod contains a measuring rod secured adjacent the mounting end of the bolt rod and extending loosely through the bolt head, it will be possible to directly measure with simple means the deformation which has occurred.

In a design which permits of a particularly simple manufacture of the rock bolt, the outer end of the tubular member is expanded to be supported on the rim of the passage opening of the retaining plate and the inner end of the tubular member is constricted to form the collar or to support a ring constituting the collar, and the bolt head consists of an anchor nut adapted to be inserted into the tubular member and to be screwed on a screw-threaded end of the bolt rod. That design will also result only in a small projection from the borehole in the first mounting position and the bolt rod will be drawn into the tubular member against the resistance that is presented by the upsettable member, which is inserted into the borehole together with the tubular member. By a simple tightening of the nut which constitutes the bolt head in the retaining plate, which has been carried along by the expanded end of the tubular member, is prestressed in the inserted position against the outside surface of the borehole and/or against supporting member which is to be mounted between the rock and the retaining plate and has, e.g., a large surface, and the tubular member is presetressed by means of the upsettable member in the direction in which it is displaced into the borehole.

If a thrust ring adapted to be mounted between the anchor nut and the sleeve member is guided in the tubular member the pressure-applying ring may produce a part of the retaining force owing to the frictional coupling to the inside surface of the tubular member.

The upsettable sleeve member may consist of a plastically deformable material, such as a softer metal or a metal alloy or a plastic. The tubular member and/or the parts formed with the thrust faces leave passage openings through which the sleeve material can be extruded, and the resistance of the material of the upsettable sleeve member to the extrusion through the passage openings will exactly define the retaining force of the bolt.

Further details and advantages of the subject manner of the invention will become apparent from the following description of the drawing.

The subject manner of the invention is illustrated by way of example on the drawing, in which FIG. 1 is a diagrammatic sectional view showing the outer end portion of a bolt rod and the supporting joint connecting said rod to the bolt head, in the inserted position.

FIG. 2 is a sectional view that is similar to FIG. 1 and shows a second embodiment.

FIG. 3 is a sectional view showing a third embodiment.

FIG. 4 is a sectional view showing a fourth embodiment.

FIG. 5 is a sectional view showing as a detail of FIG. 4 a portion of the bolt rod, tubular member and upsettable member when the upsetable member has been upset.

Figure 1:
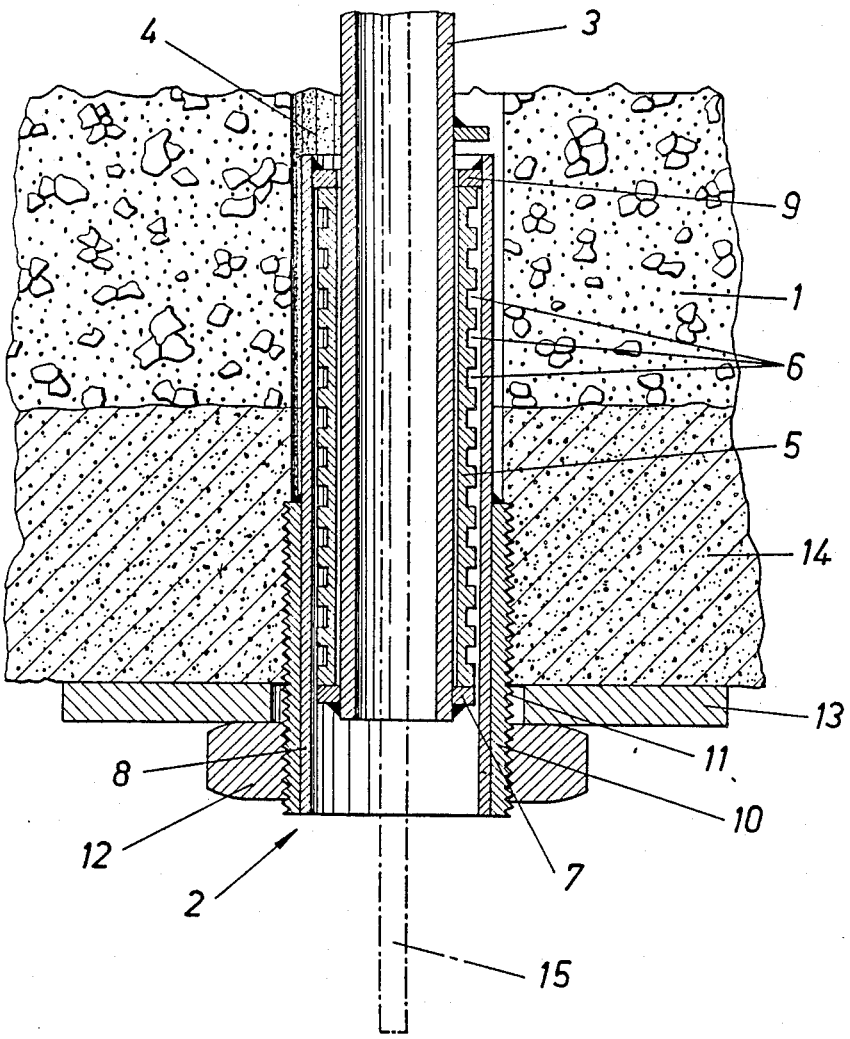

In order to protect a cavity at a cavity surface that is constituted by the rock 1, yieldable rock bolts 2 are set, which are intended to take up the rock pressure and to cause the rock to contribute to the carrying. The rock bolts 2 comprise a bolt rod 3, 3*a*, which in the embodiment shown in FIG. 1 consists of a tube 3 and in the embodiments shown in FIGS. 2 to 5 consist of a solid rod 3*a* and which is inserted into the borehole and inside the borehole, at least at its inner end portion, is reliably secured. This may be effected by sticking, a provision of a dowel, the use of mortar or an expansion of preshaped tubular end pieces by the supply of a hydraulic fluid under pressure so that the end portions are pressed together with the rock.

In accordance with FIG. 1 a sleeve 5, which constitutes an upsettable body, has been fitted with a play on the free end with which the bolt rod 3 protrudes from the borehole 4. The sleeve 5 has regularly spaced apart peripheral grooves 6. The sleeve 5 is mounted between two supporting rings 7 and 9, which have corresponding pressure-applying surfaces. The outer backing ring 7 is welded to the bolt rod 3 and the inner backing ring 9 is welded in a tubular member 8 on the inside thereof; that tubular member 8 is adapted to be inserted into the borehole. The tubular member 8 surrounds the sleeve 5 and outside the borehole 4 carries a screw-threaded sleeve 10, which has external screw threads 11 for an anchor nut 12, which is supported on a retaining plate 13, which applies pressure from the outside against the rock 1 or, as in the present case, to a gunite layer 14 or a lining element, which has a large surface and is adapted to be engaged with the rock optionally with an interposed insert, which is plastically deformable. Alternatively, the retaining plates 13 of a plurality of rock bolts 2 may be used to retain lining elements at a distance from the rock 1 so as to define a gap and that gap may be filled with gunite or placed-in-situ concrete.

When the rock bolt 2 has properly been set and has been prestressed by the tightening of the anchor nut 12, the bolt will be able to take up the pressure applied by the rock up to a certain limit load. Force will be transmitted from the rock wall 1 and the gunite layer 14 or the like via the retaining plate 13, the tubular member 8, the thrust ring 9 and the sleeve 5 to the thrust ring 7 and to the bolt rod 3. When the loads exceed the resistance of the sleeve 5 to deformation, the sleeve will be deformed by being upset in that it is compressed between the backing rings 7, 9. The course, shape and number of the peripheral grooves 6 will permit an influence to be exerted on the deformation behavior of the sleeve 5 so that the yieldability of the support can be adapted to the conditions encountered in each case. The maximum deformation of the sleeve 5 will indicate a measure of the permissible deformation which can be taken up so that the size and shape of the sleeve can be selected to provide larger deformation ranges in which the function of the rock bolt will not adversely be affected and the resistance to deformation, by which the retaining force of the rock bolt will be defined, is exactly defined. The bolt head portion protrudes from the retaining plate 13 only to a small extent.

As has been indicated in phantom the deformation which has occurred can be measured in that a measuring rod 15, which has been inserted into the hollow bolt rod 3 and is secured in the bolt rod inside the borehole and protrudes from the rim of the tubular member 8 to an extent which indicates the extent of the deformation of the sleeve 5 which has been effected.

The embodiments shown in FIG. 2 and 3 comprises sleeves 16, which have the same basic design as the sleeve 5 and which at their inner end bear on a backing ring 17 and at their outer end bear on a backing ring 18. The end of the bolt rod 3*a* is provided with a screw-threaded end portion 19, which protrudes from the borehole, in the embodiment of FIG. 2 and is provided with a screw-threaded end portion 20 which will remain in the borehole 3 in the embodiment shown in FIG. 3. The thrust ring 18, which consists of a nut, has been screwed on that screw-threaded end portion so that the relative position of the sleeve 16 and of a tubular member 21 which carries the inner thrust ring 17 relative to the bolt rod can be adjusted by a turning of that nut. The nut which constitutes the thrust ring 18 is guided for a sliding adjustment in the outer end of the tubular member 21. In accordance with FIG. 2 the tubular member 21 is succeeded by a screw-threaded sleeve 22, on which an anchor nut 23 has been screwed, which with an interposed washer 24 applies pressure to a retaining plate 25, which has an outwardly curved portion at its center.

In accordance with FIG. 3 a nut has been welded into the outer end portion of the tubular member 21 and serves to receive a screw-threaded bolt 27, which is mounted to be coaxial to the bolt rod 3*a* and the screw-threaded end portion 20 and which also applies pressure to a retaining plate 30 via an anchor nut 28 and a washer 29.

In accordance with FIGS. 4 and 5, the bolt rod 3*a* is provided with a screw-threaded end portion 31. A retaining plate 32, is used, in which the rim 33 of a passage opening for a tubular member 34 is slightly drawn inwardly. The tubular member 34 comprises an expanded outer end 35 and a conically tapered inner end 36. A thrust ring 37, which may additionally be fixed by welding, is supported on the inner end 36. A deformable sleeve 40 is arranged with a clearance within the tubular member 34 between that thrust ring 37 and a thrust ring 39, which can be clamped in position by means of an anchor nut 38. As the anchor nut 38 is tightened on the bolt rod 3*a*, which is secured at its inner end, the deformable sleeve 40 is pushed into the borehole 4 and carries the tubular member 34 along and by means of the expanded rim 35 carries also the retaining plate 32 along so that the latter is forced against the surface of the rock 1 and the part 14, which is disposed between the rock and the retaining plate 32 and which, as has been mentioned, may consists of gunite or of a lining element. When the rock is moving and the load by which the sleeve 40 is deformed is exceeded, the sleeve can deform with formation of waves, as is shown in FIG. 5, and the apices of the resulting waves will bear on the bolt rod 3*a* and in the interior of the tubular member 34 so that the deformation characteristic and the resistance to deformation will depend also on the size of the annular gap between the bolt rod and the inside surface of the tube. In order to form waves in the sleeve 40 as it is upset, the sleeve may be preformed in that it has a wave-shaped longitudinal profile by a formation of annular or helical beads. The sleeve 40 may be slightly conical. In a modification which is not shown the sleeve 40 may be replaced by a member which consists of plastically deformable material and extrusion openings are formed in the rings 37 or 39 and the material of said member will be extruded through said openings when the predetermined load has been exceeded. In addition, a deformable sleeve made of metal may be embedded in that member or other reinforcing elements may be provided within the deformable member in order to predetermine the extrusion characteristic of the external bolt fixing means and its retaining resistance. As is shown in FIG. 4 the largest diameter of the anchor nut 38 is smaller than the inside diameter of the tubular member 34 so that the anchor nut 34 can enter the tubular member as the sleeve 40 is upset.

It is also apparent from FIGS. 2 and 3 that the borehole 4 may be filled with a cement mortar or another filler during or before the mounting of the rock bolt 2.

I claim:

1. A rock bolt comprising a bolt rod adapted to be secured in a borehole, a retaining plate adapted to be attached outside the borehole, a bolt head for the retaining plate, and a supporting connection between the bolt rod and the retaining plate, the supporting connection comprising a tubular member adapted to be inserted into the bore hole, the tubular member having an outer end and an inner end, the outer tubular member end bearing on the retaining plate, and a compressively loaded, deformable and upsettable sleeve member accommodated with a clearance in the tubular member and held between a rodside thrust face and a plateside thrust face constituted by a collar adjacent the inner tubular member end.

2. The rock bolt of claim 1, wherein the rodside thrust face is constituted by a backing ring affixed to the bolt rod, the collar is affixed to the tubular member, and further comprising an anchor nut engaging the retaining plate.

3. The rock bolt of claim 2, further comprising a sleeve mounted on the outer tubular member end and having external screw threads, the anchor nut being mounted on the external screw threads.

4. The rock bolt of claim 2, further comprising a screwthreaded bolt axially projecting from the bolt rod beyond the outer tubular member end, and wherein a nut inserted in said end and screwed on the screw-threaded bolt constitutes the plateside thrust face.

5. The rock bolt of claim 1, wherein the bolt rod is hollow, further comprising a measuring rod extending through the hollow bolt rod, the measuring rod being secured adjacent a mounting end of the bolt rod and extending loosely through the bolt head.

6. The rock bolt of claim 1, wherein the retaining plate has an opening through which the tubular member passes, the outer tubular member end is outwardly flared and supported on a rim defining the retaining plate opening, the inner tubular member end is constricted and supports a ring constituting the rodside thrust face, the bolt rod has a screw-threaded end axially projecting beyond the outer tubular member end, and the bolt head is a nut screwed on the screw-threaded bolt.

7. The rock bolt of claim 6, further comprising a thrust ring constituting the plateside thrust face and extending in the tubular member between the bolt head nut and the sleeve member.

* * * * *